US009056476B2

(12) United States Patent
Nakao et al.

(10) Patent No.: US 9,056,476 B2
(45) Date of Patent: Jun. 16, 2015

(54) LIQUID EJECTING APPARATUS

(71) Applicant: Seiko Epson Corporation, Tokyo (JP)

(72) Inventors: Hajime Nakao, Azumino (JP); Katsumi Enomoto, Kanagawa-ken (JP); Shunsuke Watanabe, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/207,277

(22) Filed: Mar. 12, 2014

(65) Prior Publication Data

US 2014/0267491 A1 Sep. 18, 2014

(30) Foreign Application Priority Data

Mar. 15, 2013 (JP) ..... 2013-052884

(51) Int. Cl.
*B41J 2/165* (2006.01)
*B41J 2/14* (2006.01)

(52) U.S. Cl.
CPC ..... *B41J 2/16535* (2013.01); *B41J 2/16538* (2013.01); *B41J 2/14233* (2013.01); *B41J 2/1433* (2013.01); *B41J 2002/14362* (2013.01); *B41J 2002/14419* (2013.01); *B41J 2002/14491* (2013.01)

(58) Field of Classification Search
CPC ..... B41J 2/16535
USPC ..... 347/33
See application file for complete search history.

(56) References Cited

U.S. PATENT DOCUMENTS

2003/0234830 A1 12/2003 Sakamoto
2008/0094441 A1 * 4/2008 Okamuro et al. ..... 347/19

FOREIGN PATENT DOCUMENTS

JP 2004-082699 A 3/2004
JP 2010-228151 A 10/2010

* cited by examiner

*Primary Examiner* — Manish S Shah
*Assistant Examiner* — Jeffrey C Morgan
(74) *Attorney, Agent, or Firm* — Kilpatrick Townsend & Stockton LLP

(57) ABSTRACT

Provided is a liquid ejecting apparatus including a liquid ejecting head that ejects liquid through nozzle openings, and a wiper that sweeps a liquid ejection surface side of the liquid ejecting head, in which the liquid ejecting head includes a nozzle plate having the liquid ejection surface and a protection member that protrudes further on a liquid discharging side than the nozzle plate, and the wiper sweeps a surface of the protection member, which is an exterior surface of the protection member intended to be swept, toward the nozzle plate side, and then the wiper sweeps the liquid ejection surface so that the wiper moves away from the surface of the protection member and comes into contact with a portion between the nozzle openings on the nozzle plate and an end portion of the nozzle plate, which is located on an opposite side in a sweeping direction.

3 Claims, 7 Drawing Sheets

LIQUID EJECTING APPARATUS

This application claims priority to Japanese Application No. 2013-052884, filed on Mar. 15, 2013, the entirety of which is incorporated by reference herein.

BACKGROUND

1. Technical Field

The present invention relates to a liquid ejecting apparatus equipped with a liquid ejecting head which ejects liquid through nozzle openings and particularly relates to an ink jet type recording apparatus equipped with an ink jet type recording head which ejects ink as liquid.

2. Related Art

An ink jet type recording apparatus in which ink as liquid is ejected to perform printing on a recording medium (an ejection receiving medium), such as a paper sheet and a recording sheet, has been known as a liquid ejecting apparatus in which liquid is ejected onto an ejection receiving medium, for example.

In the case of an ink jet type recording head mounted on the ink jet type recording apparatus described above, ink droplets are discharged, through nozzle openings, onto the ejection receiving medium. Thus, ink adhering to a vicinity of the nozzle opening which is formed on a liquid ejection surface and through which the ink droplets are ejected, or the solidified ink adhering to the vicinity of the nozzle opening causes a problem, such as an unstable ink-droplet discharge direction and discharging failure, for example, ink-droplet discharging failure.

For this reason, a liquid ejecting apparatus in which a wiper blade constituted by a rubber plate or the like sweeps a liquid ejection surface to clean ink, fluff, dust, or paper dust adhering to the liquid ejection surface has been proposed (see JP-A-2010-228151, for example).

Furthermore, there is a problem in that, even in a condition where the liquid ejection surface is wiped by the wiper blade, the ejection receiving medium is stained with ink, fluff, dust, or paper dust which adheres to a surface of a protection member, such as cover head, provided on the liquid ejection surface side, when the ejection receiving medium or the like comes into contact with the protection member.

For this reason, an ink jet recording apparatus in which a concave portion is provided in a portion between the protection member and the liquid ejection surface and a surface of the protection member and the liquid ejection surface are cleaned by a wiper blade has been proposed (see JP-A-2004-82699, for example).

However, there is a problem in that, in a case where a wiper comes into contact with an end portion of a nozzle plate when the wiper, such as a wiper blade, sweeps the liquid ejection surface, a liquid repellent film formed on a surface of the nozzle plate is likely to be separated from the end portion as a starting point.

In addition, there is a problem in that a lifespan of the wiper is shortened because the wiper is cut by a corner portion of the nozzle plate when the wiper comes into contact with the end portion of the nozzle plate.

Furthermore, there is a problem in that, in a case where the nozzle plate is constituted by a silicon single crystal substrate, the nozzle plate is likely to be damaged when the wiper comes into contact with the end portion of the nozzle plate.

Incidentally, in a case where the wiper skips over the nozzle opening and lands on the liquid ejection surface, unwiped remnants are left around the nozzle opening, and thus it is difficult to suppress discharging failure.

These problems are not limited to an ink jet type recording apparatus but are common to a liquid ejecting apparatus in which liquid other than ink is ejected.

SUMMARY

An advantage of some aspects of the invention is to provide a liquid ejecting apparatus in which a vicinity of a nozzle opening is reliably cleaned and in which a liquid repellent film is prevented from being separated owing to a sweeping operation by a wiper member and a lifespan of a wiper is prevented from being shorten.

According to an aspect of the invention, there is provided a liquid ejecting apparatus including a liquid ejecting head that ejects liquid through nozzle openings, and a wiper that sweeps a liquid ejection surface side of the liquid ejecting head, in which the liquid ejecting head includes a nozzle plate having the liquid ejection surface and a protection member that protrudes further on a liquid discharging side than the nozzle plate, and the wiper sweeps a surface of the protection member, which is an exterior surface of the protection member intended to be swept, toward the nozzle plate side, and then the wiper sweeps the liquid ejection surface so that the wiper moves away from the surface of the protection member and comes into contact with a portion between the nozzle openings on the nozzle plate and an end portion of the nozzle plate, which is located on an opposite side in a sweeping direction.

In this case, the wiper moves away from the protection member and lands in the portion between the nozzle openings on the nozzle plate and the end portion of the nozzle plate, which is located on the opposite side in the sweeping direction. Therefore, it is possible to prevent the wiper from coming into contact with an end surface of the nozzle plate, which is located on the opposite side in the sweeping direction. Thus, it is possible to prevent the liquid repellent film formed on the liquid ejection surface from being separated and to prevent the wiper from wearing out. In addition, the wiper lands on the liquid ejection surface and reliably sweeps the nozzle openings and the vicinities of the nozzle openings, and thus it is possible to suppress the discharging failure owing to unwiped remnants around the nozzle openings.

It is preferable that the nozzle plate be constituted by a silicon single crystal substrate. In this case, it is possible to perform processing with high density and high accuracy and to prevent the wiper from being damaged by shock caused when the wiper comes into contact with the nozzle plate.

It is preferable that the liquid ejecting head move, relative to the wiper, in a second direction perpendicular to a first direction which is an alignment direction of the nozzle openings through which the same kind of liquid is discharged. In this case, the liquid ejecting head is reduced in size, and thus it is possible to achieve a compact liquid ejecting apparatus.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, details of embodiments of the invention will be described.

Embodiment 1

Figure 1:
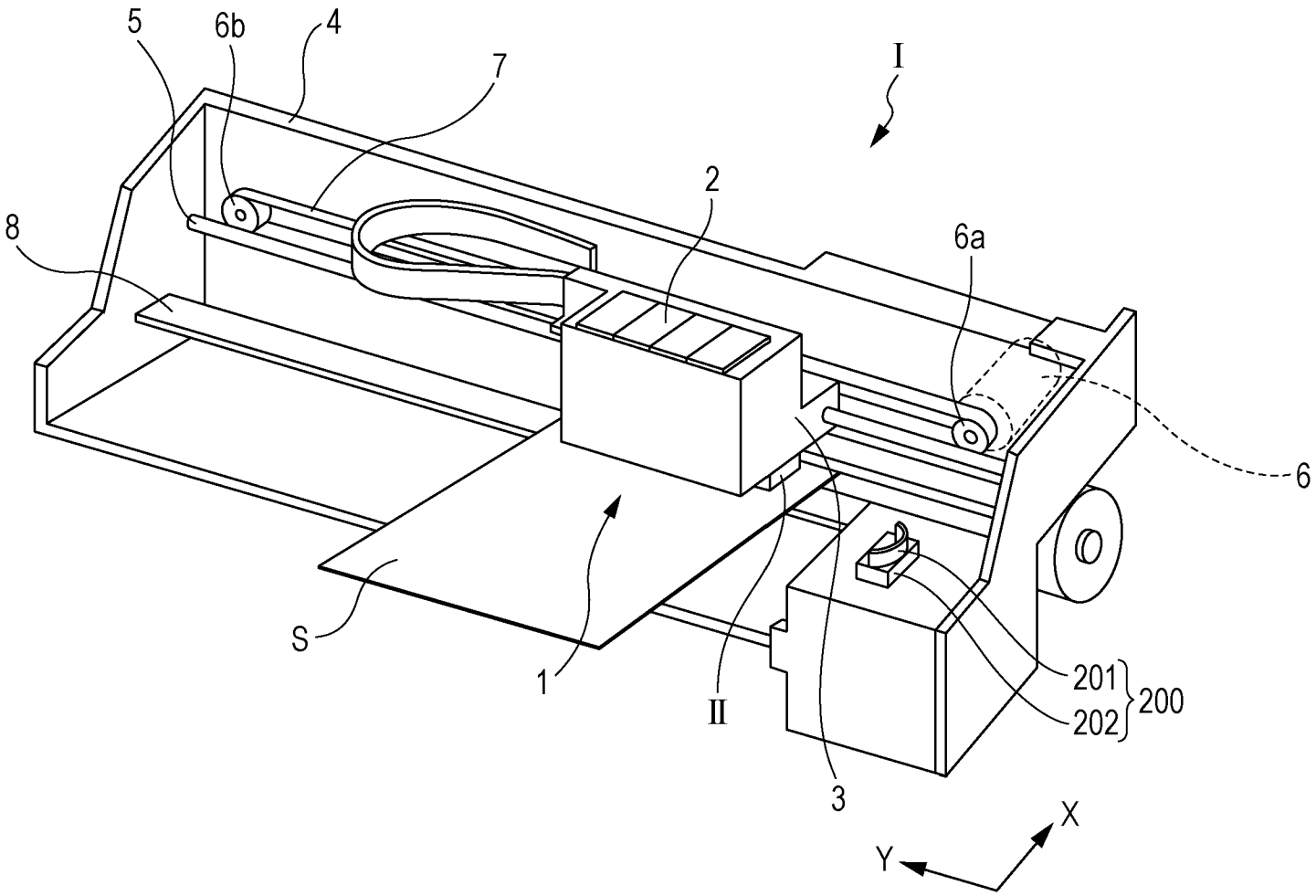
FIG. 1 is a schematic perspective view of a recording apparatus according to Embodiment 1 of the invention.

FIG. 1 is a perspective view illustrating the schematic configuration of an ink jet type recording apparatus as an example of a liquid ejecting apparatus according to Embodiment 1 of the invention.

An ink jet type recording apparatus I which is a liquid ejecting apparatus in Embodiment 1 is equipped with an ink jet type recording head unit 1 (also referred to as a head unit 1, hereinafter) including a plurality of ink jet type recording heads II (also referred to as a recording head II, hereinafter), as illustrated in FIG. 1. An ink cartridge 2 constituting an ink feeding unit is detachably installed in the head unit 1. A carriage 3 on which the head unit 1 is mounted is axially movably mounted on a carriage shaft 5 which is installed in an apparatus main body 4. This head unit 1 discharges a black-ink composition and a color-ink composition.

In addition, a driving motor 6 is provided in a vicinity of one end portion of the carriage shaft 5, and a first pulley 6*a* having a groove on the outer circumference thereof is provided in a tip portion of a shaft of the driving motor 6. Furthermore, a second pulley 6*b* which corresponds to the first pulley 6*a* of the driving motor 6 is rotatably provided in the vicinity of the other end portion of the carriage shaft 5. A timing belt 7 which has an annular shape and is formed of an elastic material such as rubber is wound between the first pulley 6*a* and the second pulley 6*b*.

In addition, a driving force from the driving motor 6 is transmitted to the carriage 3 via the timing belt 7, and thus the carriage 3 on which the head unit 1 is mounted moves along the carriage shaft 5. In Embodiment 1, the movement direction of the carriage 3 is referred to as a main scanning direction. Meanwhile, a platen 8 is provided in the apparatus main body 4 so as to extend along the carriage 3. This platen 8 is configured to be rotatable by a driving force from a paper feeding motor (not shown). A recording sheet S which is an ejection receiving medium (a recording medium), such as a paper sheet, fed by a paper feeding roller or the like, is wound around the platen 8 and transported. In Embodiment 1, the transport direction of the recording sheet S is referred to as a sub-scanning direction.

In addition, a wiper 200 which cleans a liquid ejection surface 20*a* of the ink jet type recording head II in such a manner that the wiper 200 sweeps the liquid ejection surface 20*a* is provided in a non-printing area which is an end portion in a movement direction of the carriage 3 and located on the side of the platen 8. Details of the wiper 200 will be described below.

Figure 2:
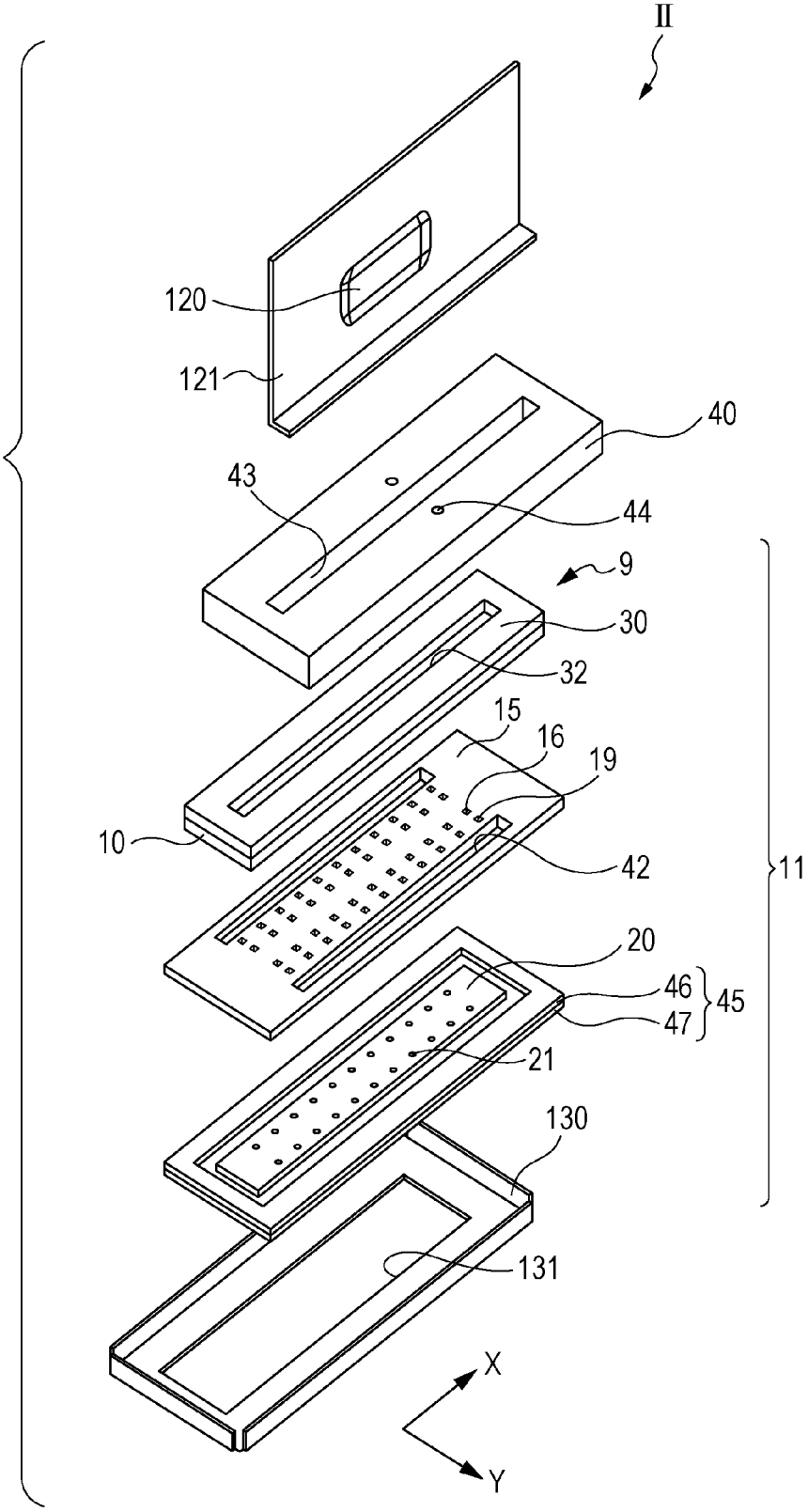
FIG. 2 is an exploded perspective view of a recording head according to Embodiment 1 of the invention.
Figure 3:
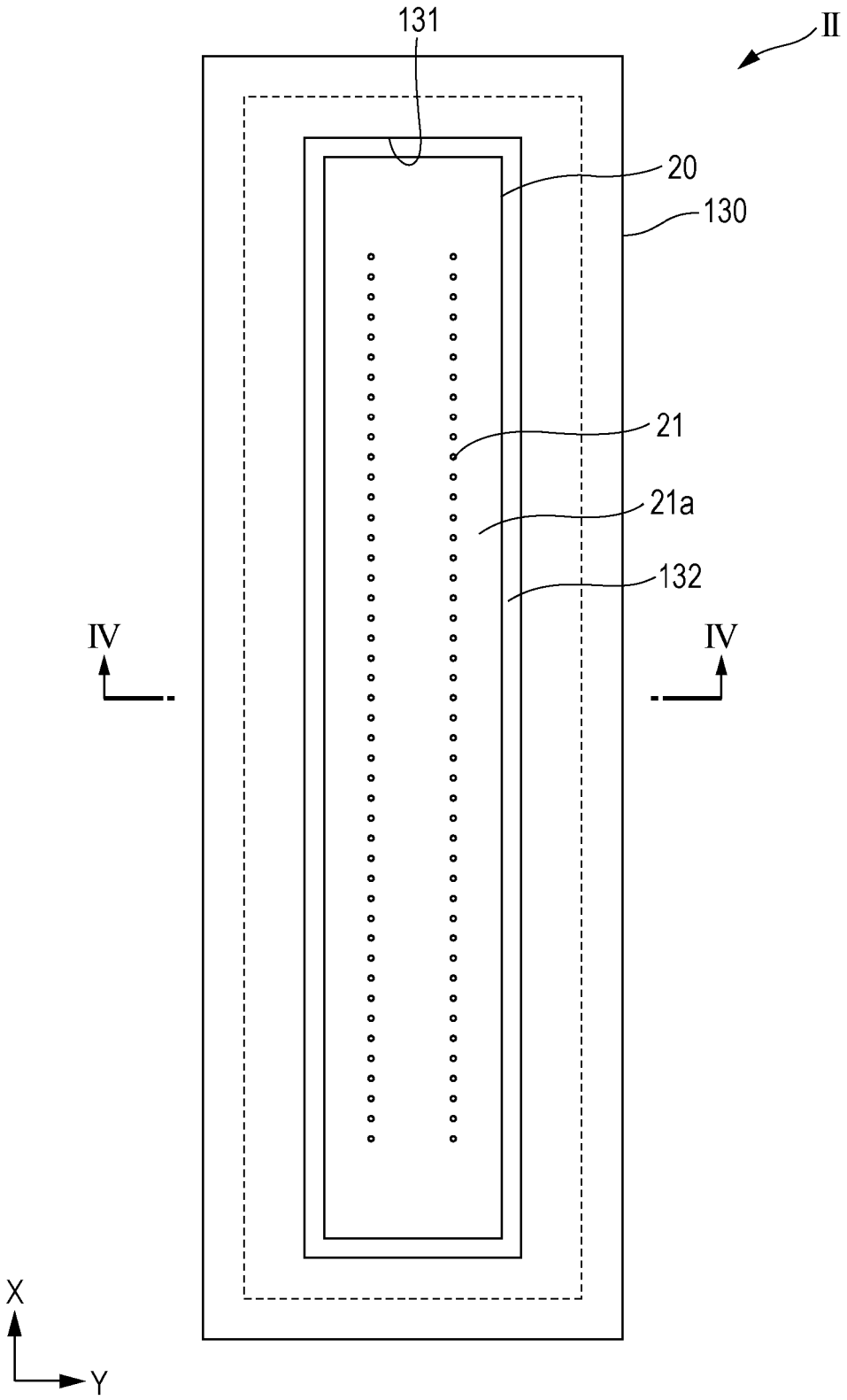
FIG. 3 is a plan view of a liquid ejection surface side of the recording head according to Embodiment 1 of the invention.
Figure 4:
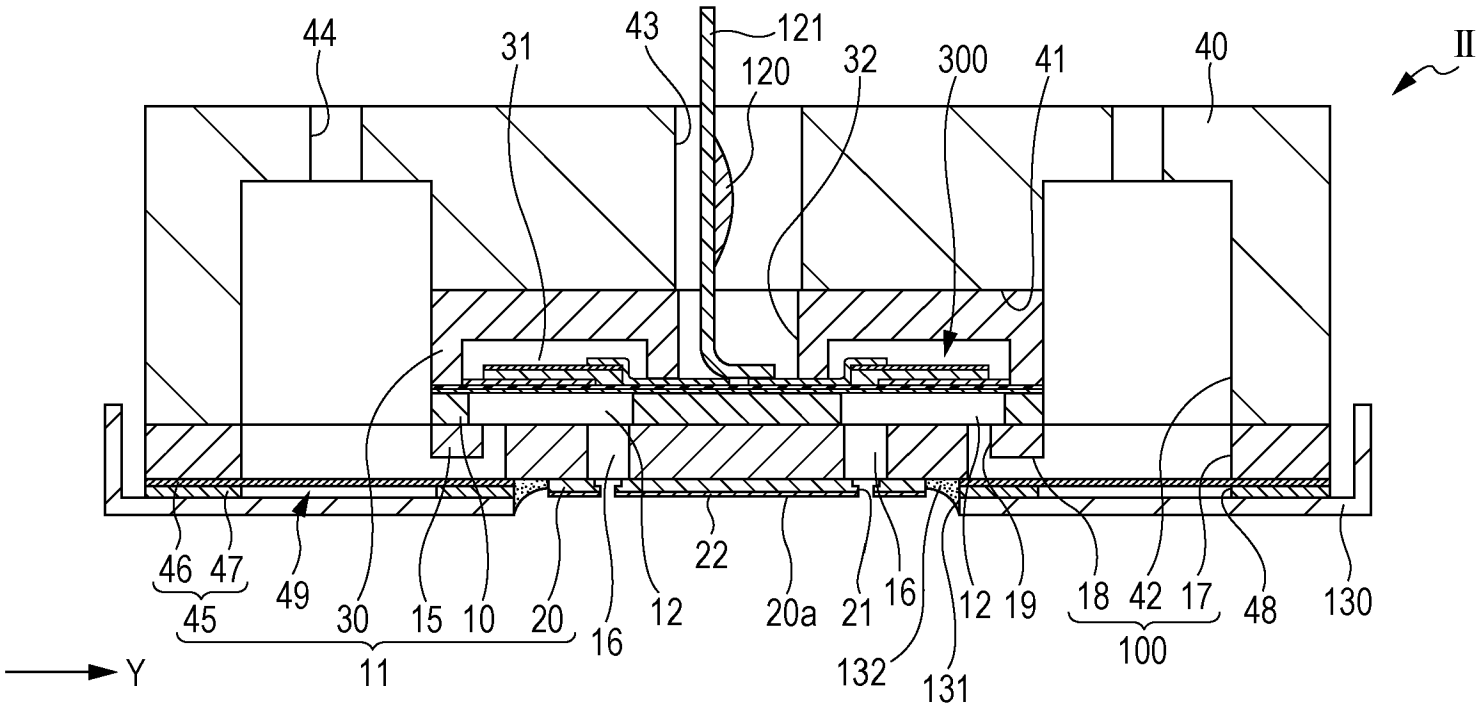
FIG. 4 is a cross-sectional view of the recording head according to Embodiment 1 of the invention.
Figure 5:
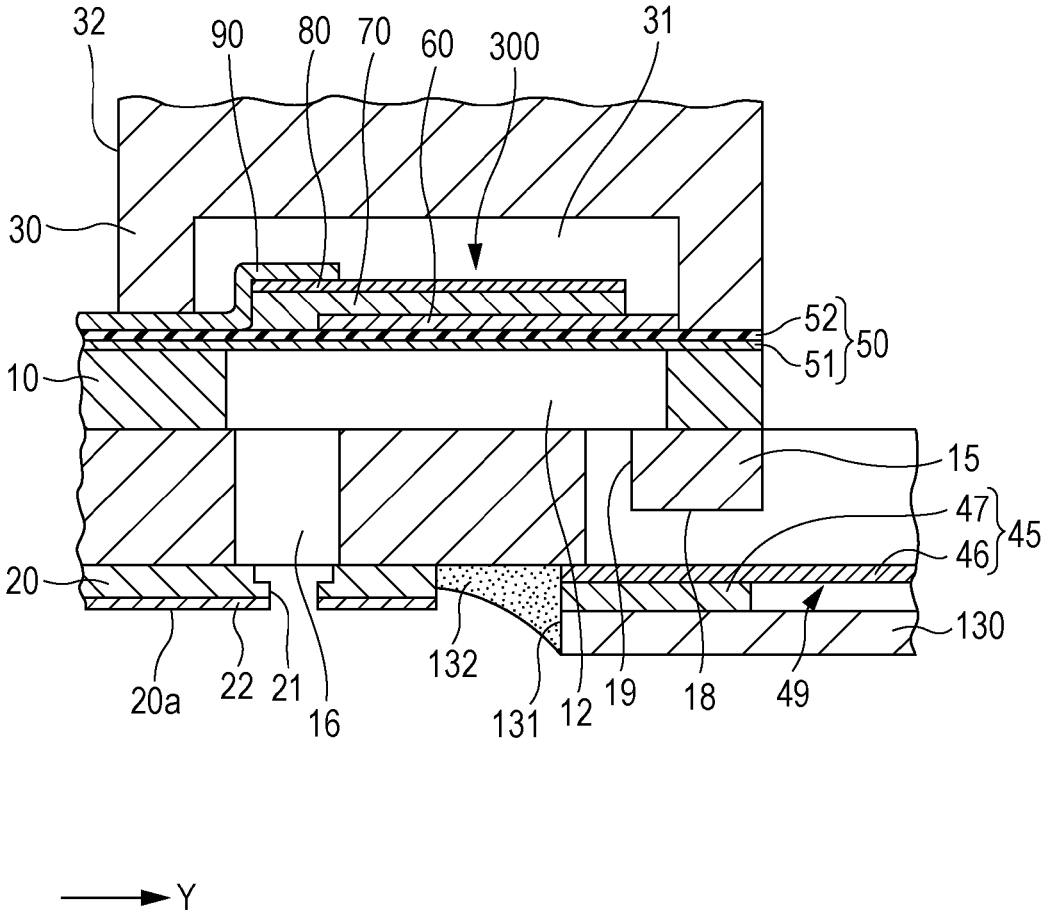
FIG. 5 is an enlarged cross-sectional view of a principal portion of the recording head according to Embodiment 1 of the invention.

Here, an example of the ink jet type recording head mounted in an ink jet type recording apparatus will be described with reference to FIGS. 2 to 4. In addition, FIG. 2 is an exploded perspective view of the ink jet type recording head, and FIG. 3 is a plan view of a liquid ejection surface side of the ink jet type recording head. FIG. 4 is a cross-sectional view taken along line IV-IV in FIG. 3, and FIG. 5 is an enlarged view of a principal portion in FIG. 4.

The ink jet type recording head II of Embodiment 1 includes a plurality of members, such as a head main body 11 and a case member 40, as illustrated in the accompanying drawings, and the plurality of members are joined to each other using an adhesive agent or the like. The head main body 11 of Embodiment 1 includes a flow-path forming substrate 10, a communication plate 15, a nozzle plate 20, a protection substrate 30, and a compliance substrate 45.

Examples of material forming the flow-path forming substrate 10 constituting the head main body 11 include metal, such as stainless steel and Ni, a ceramic material represented by $ZrO_2$ or $Al_2O_3$, a glass ceramic material, and an oxide, such as MgO and $LaAlO_3$. In Embodiment 1, the flow-path forming substrate 10 is constituted by a silicon single crystal substrate. One surface of the flow-path forming substrate 10 is subjected to anisotropic etching, and thus pressure generation chambers 12 which are partitioned by a plurality of partition walls are aligned along an alignment direction of a plurality of nozzle openings 21 through which ink is discharged. Hereinafter, this alignment direction is referred to as an alignment direction of the pressure generation chambers 12 or a first direction X. Furthermore, a plurality of rows in which the pressure generation chambers 12 are aligned in the first direction X are provided in the flow-path forming substrate 10. In Embodiment 1, the number of the rows is two. Hereinafter, the row alignment direction where the plurality of the rows in which the pressure generation chambers 12 are aligned along the first direction X is referred to as a second direction Y.

Furthermore, in the flow-path forming substrate 10, for example, a feeding path which applies a flow-path resistance to the ink flowing into the pressure generation chamber 12 and of which the size of opening is smaller than the size of the pressure generation chamber 12 may be provided in one end portion side of the pressure generation chamber 12 in the second direction Y.

In addition, the communication plate 15 is joined to one surface side of the flow-path forming substrate 10. Furthermore, the nozzle plate 20 on which a plurality of nozzle openings 21 communicating with the respective pressure generation chambers 12 is bored is joined to the communication plate 15.

A nozzle communication path 16 is provided in the communication plate 15 to cause the pressure generation chamber 12 to communicate with the nozzle opening 21. The size of the communication plate 15 is greater than the size of the flow-path forming substrate 10, and the size of the nozzle plate 20 is smaller than the size of the flow-path forming substrate 10. The size of the nozzle plate 20 is relatively small, as described above, and thus it is possible to reduce the cost. In Embodiment 1, a surface of the nozzle plate 20, on which the nozzle openings 21 are opened and from which ink droplets are discharged, is referred to as the liquid ejection surface 20*a*.

In addition, a first manifold portion 17 and a second manifold portion 18 which constitute a part of a manifold 100 are provided in the communication plate 15.

The first manifold portion 17 passes through the communication plate 15 in a thickness direction (a laminating direction of the communication plate 15 and the flow-path forming substrate 10).

In addition, the second manifold portion 18 does not pass through the communication plate 15 in the thickness direction and is opened, on the communication plate 15, toward a nozzle plate 20 side.

Furthermore, in the communication plate 15, a feeding communication path 19 which communicates with one end portion of the pressure generation chamber 12 in the second direction Y is separately provided for each pressure generation chamber 12. This feeding communication path 19 causes the second manifold portion 18 to communicate with the pressure generation chamber 12.

Examples of material forming the communication plate 15 include metal, such as stainless steel and Ni, and ceramics, such as zirconium. In addition, it is preferable that the communication plate 15 be formed of material having the same linear expansion coefficient as that of the flow-path forming substrate 10. In other words, in a case where the communication plate 15 is formed of a material of which a linear expansion coefficient is significantly different from that of the flow-path forming substrate 10, when the communication plate 15 and the flow-path forming substrate 10 are heated or cooled, bending is caused due to a difference in the linear expansion coefficient between the flow-path forming substrate 10 and the communication plate 15. In Embodiment 1, the communication plate 15 is formed of the same material as the flow-path forming substrate 10, that is, a silicon single crystal substrate. As a result, it is possible to prevent the bending due to heating, a crack or separation due to heating, or the like from occurring.

In addition, the nozzle opening 21 is formed on the nozzle plate 20 to communicate with each pressure generation chamber 12 via the nozzle communication path 16. In other words, the nozzle openings 21 through which the same types of liquids (inks) are ejected are aligned in the first direction X. Two rows in which the nozzle openings 21 are aligned in the first direction X are formed in the second direction Y.

Examples of material forming the nozzle plate 20 include metal, such as stainless steel (SUS), organic matter, such as polyimide resin, and a silicon single crystal substrate. Furthermore, the nozzle plate 20 is formed of a silicon single crystal substrate such that the linear expansion coefficient of the nozzle plate 20 is the same as that of the communication plate 15. As a result, it is possible to prevent the bending due to heating or cooling, a crack or separation due to heating, or the like from occurring.

In addition, a liquid repellent film 22 having liquid repellency (ink repellency) is provided on the liquid ejection surface 20*a* of the nozzle plate 20. The liquid repellent film 22 is not particularly limited as long as the film has ink repellency (liquid repellency) with respect to ink discharged. Examples of the liquid repellent film 22 include a metal film containing a fluorine polymer and a metallic alkoxide molecular film having liquid repellency.

In addition, the liquid ejection surface 20*a* of the nozzle plate 20 is directly subjected to eutectoid plating, and thus the liquid repellent film 22 which is constituted by a metal film containing a fluorine polymer can be formed.

In a case where a metallic alkoxide molecular film is used as the liquid repellent film 22, it is possible to improve adherence properties of the liquid repellent film 22, which is constituted by a molecular film, to the nozzle plate 20 by providing a base film, which is constituted by a plasma polymerized film, on the nozzle plate 20 side, for example. Furthermore, the base film constituted by a plasma polymerized film can be formed by polymerizing a silicone with an argon plasma gas. In the case of the liquid repellent film 22 constituted by a metallic alkoxide molecular film, a metallic-alkoxide polymerized molecular film can be formed as follows. First, a silane coupling agent, such as an alkoxysilane, is mixed with a solvent, such as a thinner, to form a metallic alkoxide solution. Then, the nozzle plate 20 is immersed in the metallic alkoxide solution. Incidentally, in a case where a metallic alkoxide molecular film is used as the liquid repellent film 22, even when a base layer is provided in the liquid repellent film 22, the liquid repellent film 22 can have a thickness smaller than a thickness of the liquid repellent film 22 which is constituted by a metal film containing a fluorine polymer and formed by a eutectoid plating method. Furthermore, it is advantageous in that an "abrasion resistance" and the liquid repellency can be improved. In this case, the "abrasion resistance" means that the liquid repellency is not deteriorated even when the liquid ejection surface 20*a* is wiped to clean the surface. Needless to say, it is also possible to apply the liquid repellent film 22 constituted by a metal film containing a fluorine polymer, though the "abrasion resistance" and the "liquid repellency" are inferior.

Meanwhile, a diaphragm 50 is formed on a surface of the flow-path forming substrate 10, which is opposite a surface facing the communication plate 15. In Embodiment 1, an elastic film 51 which is provided on the flow-path forming substrate 10 and formed from oxide silicon and an insulator film 52 which is provided on the elastic film 51 and formed from zirconium oxide are provided as the diaphragm 50. In addition, a liquid flow path, such as the pressure generation chamber 12, is formed by performing anisotropic etching on one surface side (one surface side to which the nozzle plate 20 is joined) of the flow-path forming substrate 10. The elastic film 51 is formed on the other surface side of the liquid flow path, such as the pressure generation chamber 12.

In Embodiment 1, a first electrode 60, a piezoelectric layer 70, and a second electrode 80 are laminated on the insulator film 52 of the diaphragm 50 by a film forming method and a lithography method. These members constitute a piezoelectric actuator 300. In this case, the piezoelectric actuator 300 means a portion including the first electrode 60, the piezoelectric layer 70, and the second electrode 80. Generally, either one of electrodes of the piezoelectric actuator 300 is a common electrode. The other electrode and the piezoelectric layer 70 are formed by patterning, for each pressure generation chamber 12. In this case, a portion that is constituted by either one of the electrodes and the piezoelectric layer 70 which are subjected to patterning and in which piezoelectric distortion is caused when voltage is applied to both electrodes is referred to as a piezoelectric active portion. In Embodiment 1, the first electrode 60 is used as a common electrode of the piezoelectric actuator 300 and the second electrode 80 is used as an individual electrode of the piezoelectric actuator 300. However, there is no problem even when the common electrode and the individual electrode are reversed by reason of a driving circuit configuration or a wiring configuration. Furthermore, the first electrode 60 in the example described above continuously extends over the plurality of pressure generation chambers 12, and thus the first electrode 60 functions as a part of the diaphragm. However, the configuration is not limited thereto. For example, only the first electrode 60 may function as the diaphragm, providing either one of the elastic film 51 or the insulator film 52 or neither of the two members.

In addition, the protection substrate 30 having substantially the same size as the flow-path forming substrate 10 is joined to the surface of the flow-path forming substrate 10, which is located on the piezoelectric actuator 300 side. The protection substrate 30 has a holding portion 31 as a space for protecting the piezoelectric actuator 300. In addition, a through-hole 32 which passes through in the thickness direction (the laminating direction of the flow-path forming substrate 10 and the protection substrate 30) is formed in the protection substrate 30. The other end of a lead electrode 90, which is one opposite end connected to the second electrode 80, extends to be exposed to the inside of the through-hole 32. The lead electrode 90 and a wiring circuit substrate 121 on which a driving circuit 120, such as a driving IC, is mounted are electrically connected in the through-hole 32.

In addition, the case member 40 is fixed to the head main body 11 having a configuration described above. The case member 40 and the head main body 11 form the manifold 100 which communicates with the plurality of pressure generation chambers 12. The shape of the case member 40 is substantially the same as the shape of the above-described communication plate 15, when seen in a plan view. The case member 40 is joined to both the protection substrate 30 and the communication plate 15 described above. Specifically, a concave portion 41 having a width sufficiently large to accommodate the flow-path forming substrate 10 and the protection substrate 30 is provided on the protection substrate 30 side of the case member 40. The opening size of the concave portion 41 is greater than the size of the surface of the protection substrate 30, which is joined to the flow-path forming substrate 10. Furthermore, in a state where the flow-path forming substrate 10 and the like are accommodated in the concave portion 41, the opening of the concave portion 41, which is located on the nozzle plate 20 side, is sealed by the communication plate 15. Accordingly, a third manifold portion 42 is formed on an outer circumference portion of the flow-path forming substrate 10, by the case member 40 and the head main body 11. The manifold 100 of Embodiment 1 is constituted by the first manifold portion 17, the second manifold portion 18, which are formed in the communication plate 15, and the third manifold portion 42 which is formed by the case member 40 and the head main body 11.

Examples of material forming the case member 40 include resin and metal. Incidentally, the case member 40 can be mass-produced at low cost, by applying a method in which a resin material is molded.

In addition, the compliance substrate 45 is provided on the surface of the communication plate 15, in which the first manifold portion 17 and the second manifold portion 18 are opened. This compliance substrate 45 seals openings of the first manifold portion 17 and the second manifold portion 18, which are located on the liquid ejection surface 20*a* side.

In Embodiment 1, the compliance substrate 45 described above has a sealing film 46 and a fixing substrate 47. The sealing film 46 is constituted by a thin flexible film (a thin film which is formed of polyphenylene sulfide (PPS), stainless steel (SUS), or the like and of which a thickness is equal to or less than 20 μm). The fixing substrate 47 is formed of a hard material, such as metal represented by stainless steel (SUS) or the like. A part of the fixing substrate 47, which faces manifold 100, is completely removed in the thickness direction to form an opening portion 48. Thus, one surface of the manifold 100 forms a compliance portion 49 which is a flexible portion sealed by only the sealing film 46 having flexibility.

An inlet 44 which communicates with the manifold 100 and through which the ink is supplied to the manifold 100 is provided in the case member 40. Furthermore, a connection port 43 which communicates with the through-hole 32 of the protection substrate 30 and into which the wiring circuit substrate 121 is inserted is provided in the case member 40.

In the ink jet type recording head II configured as above, when ejecting the ink, the ink is introduced from the ink cartridge 2 through the inlet 44 and the flow path from the manifold 100 to the nozzle openings 21 is filled with the ink. Then, voltage is applied, in response to a signal from the driving circuit 120, to each piezoelectric actuator 300 corresponding to the pressure generation chamber 12, and thus the piezoelectric actuator 300 and the diaphragm 50 are flexibly deformed. As a result, the pressure in the pressure generation chamber 12 increases, and thus ink droplets are ejected through the predetermined nozzle openings 21. In the ink jet type recording head II of Embodiment 1, a path from the inlet 44 to the nozzle openings 21 is referred to as a liquid flow path. In other words, the liquid flow path is constituted by the inlet 44, the manifold 100, the feeding communication path 19, the pressure generation chamber 12, the nozzle communication path 16, and the nozzle openings 21.

In addition, a cover head 130 as a protection member of Embodiment 1 is provided on the liquid ejection surface 20*a* side of the head main body 11. The cover head 130 is joined to a surface side of the compliance substrate 45, which is opposite the communication plate 15 side. The cover head 130 seals a space in the compliance portion 49, which is located on a side opposite the flow path (the manifold 100). An exposure opening portion 131 through which the nozzle openings 21 are exposed is provided in the cover head 130. The exposure opening portion 131 of Embodiment 1 has a size sufficiently large to allow the nozzle plate 20 to be exposed, that is, the same size as the opening formed in the compliance substrate 45.

In Embodiment 1, an end portion of the cover head 130 bends from the liquid ejection surface 20*a* side to cover a side surface (a surface intersecting with the liquid ejection surface 20*a*) of the head main body 11.

The cover head 130 of Embodiment 1 protrudes, in an ink (liquid) discharge direction, further on the recording sheet S side than the liquid ejection surface 20*a* of the nozzle plate 20. It is difficult for the recording sheet S to come into contact with the nozzle plate 20, because the cover head 130 protrudes further on the recording sheet S side than the liquid ejection surface 20*a*, as described above. Thus, it is possible to prevent the nozzle plate 20 from being deformed or separated due to the recording sheet S contacting with the nozzle plate 20.

Furthermore, a liquid repellent film having liquid repellency may be provided on a surface of the cover head 130, which is located on the same side as the liquid ejection surface 20*a*, that is, a surface located on a side opposite the compliance substrate 45, as similar to the nozzle plate 20.

In Embodiment 1, a gap between the nozzle plate 20 and the exposure opening portion 131 of the cover head 130 is filled with a filler material 132. In the nozzle plate 20 side, the filler material 132 is formed in a position (in terms of a direction opposite a liquid ejecting direction) lower than the liquid ejection surface 20*a*. Also, in the cover head 130 side, the filler material 132 is formed in a position lower than the surface of the cover head 130. Thus, it is possible to prevent the filler material 132 from coming into contact with the wiper 200 and being separated to cause a foreign matter, when the wiper 200 sweeps the surface of the cover head 130 and the liquid ejection surface 20*a* of the nozzle plate 20. Details of this effect will be described below. Furthermore, the filler material 132 is provided as described above, and thus it is possible to prevent the ink, which stays in a portion between the nozzle plate 20 and the cover head 130, from dropping onto the recording sheet S at an unexpected timing and staining the recording sheet S.

A material forming the filler material 132 is not particularly limited as long as the material has a liquid resistance. Examples of the material forming the filler material 132 include an adhesive agent and the like. Furthermore, the filler material 132 may be part of an adhesive agent which is used for adhering the cover head 130 to the compliance substrate 45, for example.

The ink jet type recording head II described above is mounted to the ink jet type recording apparatus I in a state where the second direction Y is parallel to a main scanning direction which is a movement direction of the carriage 3.

Figure 6A:
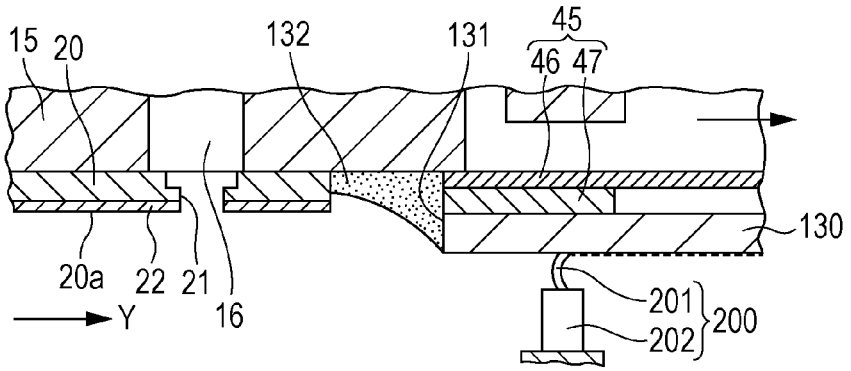
FIGS. 6A to 6C are cross-sectional views illustrating operations of the recording apparatus according to Embodiment 1 of the invention.
Figure 6B:
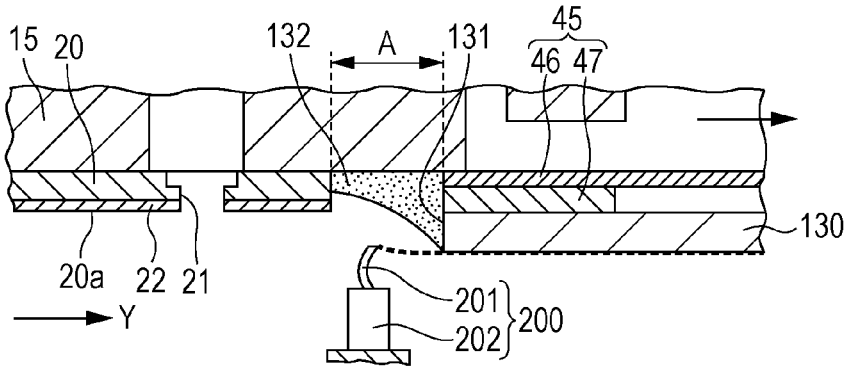
Figure 6C:
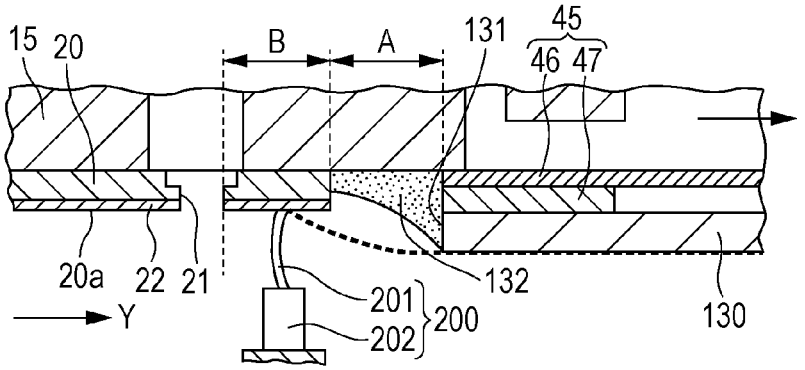

Here, details of the wiper 200 for cleaning the liquid ejection surface 20*a* of the ink jet type recording head II will be described with reference to FIGS. 1 to 6C. FIGS. 6A to 6C are cross-sectional views of principal portions for illustrating a cleaning operation.

The wiper 200 of Embodiment 1 has a blade portion 201 which is constituted by a plate-shaped member formed from an elastic material, such as rubber or an elastomer, and a base portion 202 to which the blade portion 201 is fixed.

In the ink jet type recording apparatus I, the base portion 202 is disposed in an area, namely, a non-printing area, outside an area within which the ink lands on the recording sheet S and is located at a position opposite the liquid ejection surface 20*a*, as illustrated in FIG. 1. The base portion 202 may be configured to be movable in an ink-droplet discharge direction, for example.

A base end portion of the blade portion 201 is fixed to the base portion 202 such that a tip of the blade portion 201 is set to be a free end. In addition, the blade portion 201 is disposed in a state where a plane direction is parallel to the first direction X and in a state where the tip, that is, the free end, protrudes toward the liquid ejection surface 20*a*.

Furthermore, the blade portion 201 of Embodiment 1 is disposed in a state where the blade portion 201 bends with respect to a straight line in the first direction X such that one surface of the blade portion 201 has a concave portion shape.

A length of the blade portion 201 is set to be longer than a length of the row, in which the nozzle openings 21 formed on the nozzle plate 20 are aligned, in the first direction X. In Embodiment 1, a length of the blade portion 201 in the first direction X is set to be longer than a length of the cover head 130 in the first direction X. Accordingly, the blade portion 201 can sweep the entire surface of the cover head 130 and the liquid ejection surface 20*a*.

The wiper 200 wipes the liquid ejection surface 20*a* in such a manner that the blade portion 201 moves in the second direction Y relative to the ink jet type recording head II, and thus the tip of the blade portion 201 sweeps the liquid ejection surface 20*a*.

In Embodiment 1, the relative movement of the blade portion 201 (the wiper 200) to the ink jet type recording head II is performed in such a manner that the carriage 3 on which the ink jet type recording head II is mounted moves in the main scanning direction (the second direction Y). Needless to say, the relative movement of the wiper 200 to the ink jet type recording head II is not limited to an operation in which the carriage 3 moves. The relative movement may be operated as follows. A movement unit, for example, may be installed to move the wiper 200 in the main scanning direction (the second direction Y), and the movement unit may cause the wiper 200 to move in a state where the carriage 3 on which the ink jet type recording head II is mounted is stopped. Alternatively, the wiper 200 may move in a sub-scanning direction relative to the ink jet type recording head II such that the blade portion 201 sweeps the liquid ejection surface 20*a* in the first direction X.

The blade portion 201 of the wiper 200 configured as above sweeps the surface of the cover head 130, and then sweeps the liquid ejection surface 20*a* of the nozzle plate 20.

Specifically, the ink jet type recording head II moves in the second direction Y relative to the wiper 200, and thus the tip of the blade portion 201 sweeps the surface (on the liquid ejection surface 20*a* side) of the cover head 130, as illustrated in FIG. 6A. As a result, the wiper 200 wipes off ink (liquid), fluff, dust, or paper dust adhering to the surface of the cover head 130.

Subsequently, when the ink jet type recording head II further moves in the second direction Y relative to the wiper 200, the tip of the blade portion 201 moves away from an end portion of the cover head 130, which is located on the nozzle plate side, as illustrated in FIG. 6B, and the tip of the blade portion 201 lands in an area B on the liquid ejection surface 20*a*, which is an area between the nozzle opening 21 of the nozzle plate 20 and an end portion of the nozzle plate 20, which is located on an opposite side in a sweeping direction (the second direction Y in Embodiment 1), as illustrated in FIG. 6C. In this case, the end portion of the nozzle plate 20, which is located on the opposite side in the sweeping direction, means the end portion of the nozzle plate 20, which is adjacent to a side of an area on the cover head 130, which has been swept by the blade portion 201. The nozzle opening 21 defining the area B is one of the nozzle openings 21, which is located at a position closest to the end portion of the nozzle plate 20, which is located on the opposite side in the sweeping direction. More specifically, the nozzle opening 21 defining the area B means an edge of the opening, which is adjacent to the end portion of the nozzle plate 20, which is located on the opposite side in the sweeping direction. In other words, the area B is an area between the edge of the nozzle opening 21 located at the position closest to the end portion of the nozzle plate 20, which is located on the opposite side in the sweeping direction, and the end portion of the nozzle plate 20, which is located on the opposite side in the sweeping direction of the nozzle plate 20. The area B does not include the edge of the nozzle opening 21 and an end surface of the nozzle plate 20.

Next, the blade portion 201 lands in the area B of the liquid ejection surface 20*a*, and then the ink jet type recording head II moves in the second direction Y relative to the wiper 200, as illustrated in FIG. 6C. As a result, the blade portion 201 passes through an upper portion of the nozzle opening 21, and thus the vicinity of the nozzle opening 21 is cleaned. Subsequently, a surface of the cover head 130, which is located on a sweep-direction side in the second direction Y, is swept after the liquid ejection surface 20*a* is cleaned. Thereby, the surface of the cover head 130 is cleaned, and then a cleaning operation is finished.

The blade portion 201 sweeps the surface of the cover head 130, and then the blade portion 201 lands in the area B of the liquid ejection surface 20*a* on the nozzle plate 20 and cleans the liquid ejection surface 20*a*, as described above. Thus, it is possible to prevent the blade portion 201 from coming into contact with the end surface (a corner portion) of the nozzle plate 20. As a result, it is possible to suppress the separation of the liquid repellent film 22 which is formed on the liquid ejection surface 20*a* on the nozzle plate 20.

Furthermore, the blade portion 201 lands in the area B of the liquid ejection surface 20*a*, and this makes it possible to prolong a lifespan of the blade portion 201. Incidentally, when the blade portion 201 sweeps the corner portion of the nozzle plate 20, the blade portion 201 is cut by the corner portion of the nozzle plate 20.

Furthermore, the blade portion 201 lands in the area B of the liquid ejection surface 20*a*, and thus it is possible to prevent the nozzle plate 20 from being damaged, even in a case where the nozzle plate 20 is formed of brittle material, such as a silicon single crystal substrate. In other words, in a case where the nozzle plate 20 is formed of brittle material, such as a silicon single crystal substrate, the nozzle plate 20 is likely to be damaged by shock caused when the blade portion 201 comes into contact with the end surface of the nozzle plate 20.

The blade portion 201 lands in the area B of the liquid ejection surface 20*a*, and then the blade portion 201 can sweep the nozzle opening 21 and the vicinity of the opening. Thus, it is possible to reliably remove ink or a foreign matter adhering around the nozzle opening 21. Incidentally, in a case where the blade portion 201 skips over the nozzle opening 21 and lands on the liquid ejection surface 20*a*, the foreign matter around the nozzle opening 21 is not removed and thus unwiped remnants are left. This can cause ink-droplet discharging failure or the like.

For causing the blade portion 201 to land in the area B between the nozzle opening 21 and the end portion of the nozzle plate 20, which is located on the opposite side in the sweeping direction, it is necessary to appropriately adjust a width of the area A, a width of the area B, a level difference between the liquid ejection surface 20*a* and the cover head 130, a movement speed of the blade portion 201 relative to the ink jet type recording head, material properties (an elastic property) of the blade portion 201, a push-in amount of the blade portion 201 or the like.

Figure 7:
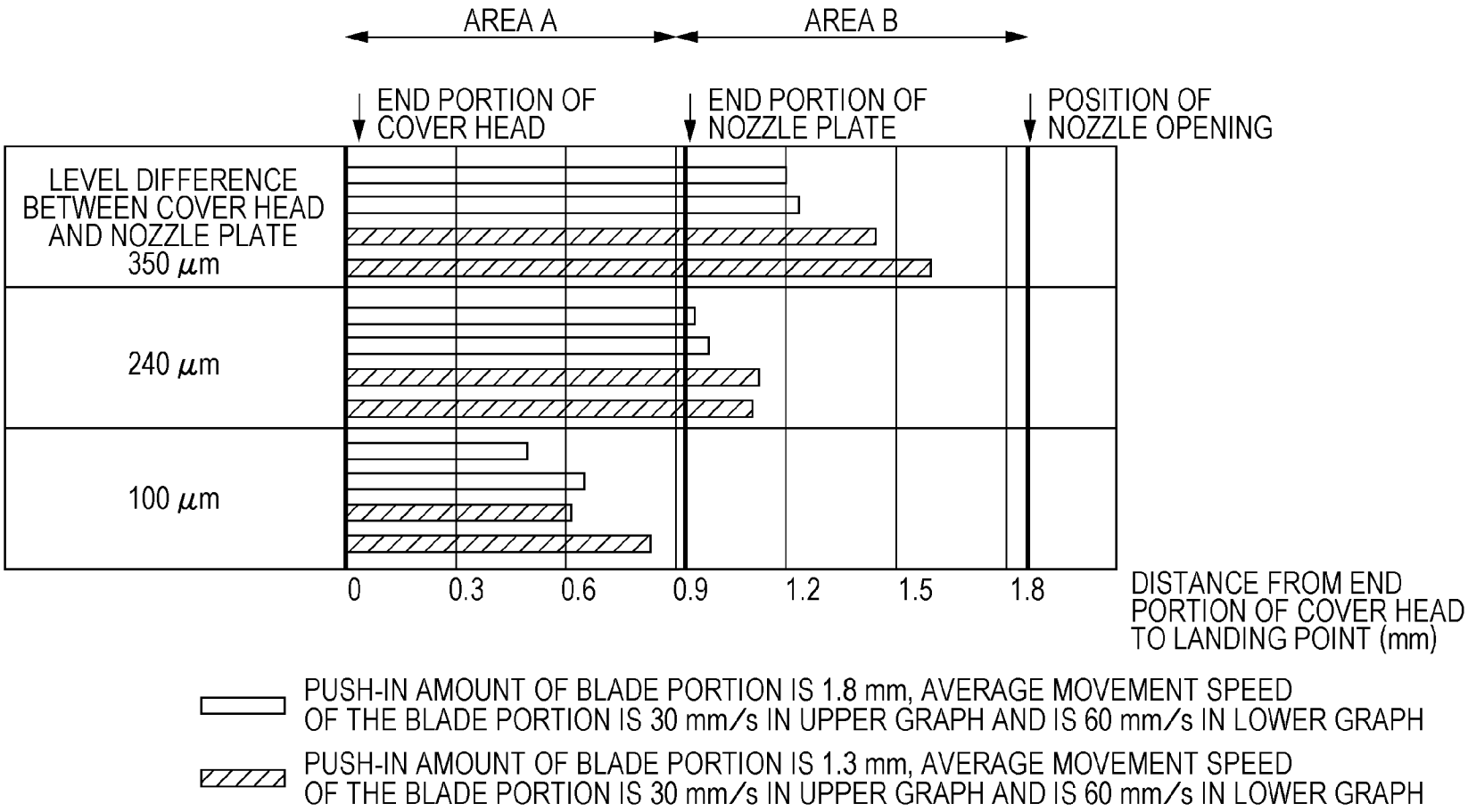
FIG. 7 is a graph illustrating simulation results of landing positions of a wiper.

Here, simulation results of a landing position of the blade portion 201, in which various parameters are changed, are illustrated in FIG. 7. FIG. 7 is a graph illustrating simulation results of landing positions of the wiper 200.

As illustrated in FIG. 7, when the level difference between the cover head 130 and the blade portion 201 is set to be 350 μm, the blade portion 201 lands in the area B, in any case where the movement speed of the blade portion 201 is set to be 30 mm/s or 60 mm/s and the push-in amount of the blade portion 201 is set to be 1.8 mm or 1.3 mm.

Similarly, when the level difference between the cover head 130 and the blade portion 201 is set to be 240 μm, the blade portion 201 lands in the area B, in any case where the movement speed of the blade portion 201 is set to be 30 mm/s or 60 mm/s and the push-in amount of the blade portion 201 is set to be 1.8 mm or 1.3 mm.

However, when the level difference between the cover head 130 and the blade portion 201 is set to be 100 μm, the blade portion 201 lands not in the area A but in the area A, in any case where the movement speed of the blade portion 201 is set to be 30 mm/s or 60 mm/s and the push-in amount of the blade portion 201 is set to be 1.8 mm or 1.3 mm.

In a case where the area B of the liquid ejection surface 20*a* or the area A between the liquid ejection surface 20*a* and the cover head 130 is wide, the size and the cost of the ink jet type recording head are increased. Thus, the size of the ink jet type recording head can be reduced by setting the widths of the area A and area B to be as narrow as possible. Specifically, the wiper 200 of Embodiment 1 sweeps the liquid ejection surface 20*a* in such a manner where the wiper 200 moves in the second direction Y relative to the liquid ejection surface 20*a*, and thus the following problem is caused in a case where the area B between the nozzle opening 21 and the end portion of the nozzle plate 20, which is located on the opposite side in the sweeping direction, is wide. A distance between the nozzle rows is set to be great when a plurality of the ink jet type recording heads II are mounted. Accordingly, it is preferable that the width of the area B be set to be as narrow as possible.

The blade portion 201 cleans the surface of the cover head 130, which is located on the liquid ejection surface 20*a* side, as described above. Thus, it is possible to prevent the foreign matter, such as ink, adhering to the cover head 130 from staining the recording sheet S. Furthermore, the blade portion 201 lands in the area B of the liquid ejection surface 20*a* after cleaning the cover head 130, and thus it is possible to suppress the separation of the liquid repellent film 22 by the blade portion 201. In addition, the blade portion 201 lands in the area B, and then the blade portion 201 can reliably clean the foreign matter in the vicinity of the nozzle opening 21. Thus, it is possible to prevent the discharge failure owing to unwiped remnants from being caused. Furthermore, the blade portion 201 does not sweep the end surface of the nozzle plate 20, and thus it is possible to prevent the nozzle plate 20 from being damaged and to prevent the blade portion 201 from wearing out.

Other Embodiments

Hereinbefore, an embodiment of the invention is described. However, the basic configuration of the invention is not limited thereto.

In Embodiment 1 described above, a wiper which has the blade portion 201 constituted by a plate-shaped member and the base portion 202 is exemplified as the wiper 200, for example. However, without being limited thereto, a porous material, such as a sponge, or non-woven fabric, for example, may be used as the wiper 200 to sweep the liquid ejection surface 20*a*. In other words, the material or the shape of the wiper 200 is not limited as long as the wiper 200 sweeps the liquid ejection surface 20*a* and cleans the liquid ejection surface 20*a*, for example.

In Embodiment 1, the blade portion 201 of the wiper 200 sweeps the liquid ejection surface 20*a* on the ink jet type recording head II in such a manner that the wiper 200 moves in the second direction Y relative to the liquid ejection surface 20*a*. However, the sweeping movement is not particularly limited thereto and the wiper 200 may sweep the liquid ejection surface 20*a* in such a manner that the wiper 200 moves in the first direction X relative to the liquid ejection surface 20*a*.

In Embodiment 1 described above, one cover head 130 (the exposure opening portion 131) is provided for each head main body 11. However, the configuration is not particularly limited thereto and one cover head may be provided for two or more head main bodies 11, for example. In this case, the exposure opening portion 131 may be provided in the cover head for each head main body 11, and a plurality of the head main bodies 11 may be exposed through one exposure opening portion 131.

In the ink jet type recording apparatus I of Embodiment 1 described above, the ink jet type recording head II (the head unit 1) moves in the main scanning direction in a state where the ink jet type recording head II is mounted on the carriage 3. However, the configuration is not particularly limited thereto and this invention can be applied to a so-called line-type recording apparatus in which the ink jet type recording apparatus I is fixed and only the recording sheet S, such as a paper sheet, moves in the sub-scanning direction to perform printing, for example.

In the example described above, the ink jet type recording apparatus I has a configuration in which the ink cartridge 2 as a liquid storage unit is mounted on the carriage 3. However, the configuration is not particularly limited thereto. The liquid storage unit, such as an ink tank, may be fixed to the apparatus main body 4 and the storage unit and the ink jet type recording head II may be connected through a feeding tube, such as a tube, for example. Furthermore, the liquid storage unit may not be mounted on the ink jet type recording apparatus.

In the description of Embodiment 1, the piezoelectric actuator 300 of a thin film type is used as a pressure generation unit for changing the pressure in the pressure generation chamber 12. However, the pressure generation unit is not limited thereto. A thick-film type piezoelectric actuator which is formed by, for example, a greensheet-paste method or a longitudinal-oscillation type piezoelectric actuator which is formed by laminating a piezoelectric material and an electrode forming material on each other and which expands and contracts in an axial direction can be used as the pressure generation unit, for example. Furthermore, a unit in which a heater element is provided in a pressure generation chamber and which causes liquid droplets to be discharged through nozzle openings by using bubbles generated by the heating of the heater element, or a so-called electrostatic actuator in which static electricity is generated between a diaphragm and an electrode and which causes the diaphragm to be deformed and liquid droplets to be discharged through nozzle openings by using the electrostatic force can be used as the pressure generation unit, for example.

In the description of the embodiment, the ink jet type recording apparatus equipped with the ink jet type recording head is used as an example of the liquid ejecting apparatus. However, the present invention is intended to be applied to general types of liquid ejecting apparatuses. The present invention can also be applied to a liquid ejecting apparatus equipped with a liquid ejecting head which ejects liquid other than ink. Other examples of the liquid ejecting head include various types of recording heads which are applied to image recording apparatuses, such as a printer, a coloring material ejecting head used to manufacture a color filter for a liquid crystal display or the like, an electrode material ejecting head used to form an electrode for an organic EL display, a field emission display (FED) or the like, a bio-organic material ejecting head used to manufacture a biochip, or the like. The present invention can be applied to a liquid ejecting apparatus equipped with the liquid ejecting head described above.

What is claimed is:

1. A liquid ejecting apparatus comprising:

a liquid ejecting head comprising:

a nozzle plate defining a liquid ejection surface;

nozzle openings defined in the liquid ejection surface, wherein the liquid ejecting head ejects liquid through the nozzle openings; and a protection member that protrudes beyond the nozzle plate in a liquid discharge direction; and a wiper, wherein:

the wiper sweeps an exterior surface of the protection member toward the nozzle plate, in a sweeping direction transverse to the liquid discharge direction;

at least a portion of the wiper subsequently loses contact with the liquid ejecting head while the wiper moves farther in the sweeping direction, the wiper thereby not contacting a corner of the nozzle plate;

the portion of the wiper subsequently recontacts the liquid ejecting head at a region of the liquid ejection surface beyond the corner in the sweeping direction; and the wiper subsequently sweeps the liquid ejection surface in the sweeping direction.

2. The liquid ejecting apparatus according to claim 1, wherein the nozzle plate is constituted by a silicon single crystal substrate.

3. The liquid ejecting apparatus according to claim 1, wherein the liquid ejecting head moves, relative to the wiper, in a second direction perpendicular to a first direction which is an alignment direction of the nozzle openings through which the same kind of liquid is discharged.

* * * * *